US005603138A

United States Patent [19]

Bonis

[11] Patent Number: 5,603,138

[45] Date of Patent: Feb. 18, 1997

[54] GLASS CLEANING DEVICE

[76] Inventor: Jacquelynn A. Bonis, 9849 E. Windrose Dr., Scottsdale, Ariz. 85260

[21] Appl. No.: 384,752

[22] Filed: Feb. 7, 1995

[51] Int. Cl.[6] ..... A47L 13/20

[52] U.S. Cl. ..... 15/220.1; 15/231; 15/145; 15/144.1; 15/244.2; 403/344; 403/375

[58] Field of Search ..... 15/231, 232, 230.19, 15/230.18, 230.17, 233, 208, 209.1, 220.1, 229.7, 229.6, 244.2, 145, 143.1, 144.1, 146, 147.1, 150, 149, 177, 178, 176.6, 176.1, 176.3, 176.2, 228; 403/313, 344, 345, 375

[56] References Cited

U.S. PATENT DOCUMENTS

| | | | |
|---|---|---|---|
| 1,460,329 | 6/1923 | King | 15/231 |
| 1,470,857 | 10/1923 | Lupo | 15/231 |
| 1,508,541 | 9/1924 | Cross | 15/230 |
| 1,509,381 | 9/1924 | Townsend | 15/210.1 |
| 1,596,663 | 8/1926 | Kirsch | 15/231 |
| 1,714,350 | 5/1929 | De Jong | 15/231 |
| 2,301,586 | 11/1942 | Rubin | 15/228 |
| 2,304,127 | 12/1942 | Stetson | 15/231 |
| 2,396,973 | 3/1946 | Schmidt | 15/231 |
| 2,797,968 | 7/1957 | Le Febvre et al. | 15/147.1 |
| 2,873,464 | 2/1959 | Rosenthal | 15/231 |
| 2,911,661 | 11/1959 | Bales | 15/231 |
| 2,934,775 | 5/1960 | Bergstrom | 15/230 |
| 2,941,294 | 6/1960 | Vosbikian et al. | 15/145 |
| 2,996,745 | 8/1961 | Ballinger | 15/229.8 |
| 3,012,264 | 12/1961 | Nash | 15/231 |
| 3,027,585 | 4/1962 | Freedman et al. | 15/230.19 |
| 3,164,854 | 1/1965 | Hess et al. | 15/230.19 |
| 4,106,153 | 8/1978 | Lemelson | 15/231 |
| 4,225,998 | 10/1980 | Thielen | 15/231 |
| 4,965,905 | 10/1990 | Kitahata et al. | 15/230.19 |

FOREIGN PATENT DOCUMENTS

| | | | |
|---|---|---|---|
| 120411 | 12/1947 | Sweden | 15/231 |
| 111316 | 8/1925 | Switzerland | 15/231 |
| 501744 | 3/1939 | United Kingdom | 15/230.19 |
| 559372 | 2/1944 | United Kingdom | 15/230.19 |
| 795436 | 5/1958 | United Kingdom | 15/229.8 |

*Primary Examiner*—Gary K. Graham

*Attorney, Agent, or Firm*—Harry M. Weiss; Jeffrey D. Moy; Harry M. Weiss & Associates, P.C.

[57] ABSTRACT

An article for cleaning windows and vehicle interior windows includes a rigid backing element, a deformable backing element and a rubber ring having an unstretched circumference smaller than that of the rigid backing element. The backing elements are juxtaposed with one another and a paper towel is placed against the deformable backing element. The paper towel projects laterally and longitudinally of the backing elements. The ring is positioned adjacent the side of the paper towel which faces away from the backing elements. The ring is then drawn towards the rigid backing element and, in the process, folds the projecting portions of the paper towel around the backing elements. The ring is stretched to fit around the rigid backing element and, when released, clamps the projecting portions of the paper towel between itself and the rigid backing element. As a result, the portion of the paper towel adjacent the deformable backing element is firmly held and can be used for cleaning. The rigid backing element carries a connector for a handle.

16 Claims, 3 Drawing Sheets

GLASS CLEANING DEVICE

BACKGROUND OF THE INVENTION

1. Field of the Invention

The invention relates to a cleaning article.

2. Description of the Related Art

Automobile interiors accumulate dust which needs to be removed on occasion. Although a duster can be used for this purpose, dust tends to adhere to the duster, thereby reducing its effectiveness.

Over time, a dirt film forms on the interior surfaces of automobile windows as well as on the surfaces of other types of windows. This film is normally removed by means of a cloth or paper towel. However, no effective manner of gripping the cloth or paper towel has been developed to date, with the result that it is difficult to manipulate the cloth or paper towel.

SUMMARY OF THE INVENTION

It is an object of the invention to provide a cleaning article which makes it possible to clean more efficiently.

Another object of the invention is to provide a cleaning article having versatility.

An additional object of the invention is to provide a method of producing a cleaning article capable of cleaning more effectively.

A further object of the invention is to provide a method of generating a relatively versatile cleaning article.

The preceding objects, as well as others which will become apparent as the description proceeds, are achieved by the invention.

One aspect of the invention resides in a cleaning article. The cleaning article comprises a backing portion and a gripping portion discrete from the backing portion for releasably holding a cleaning member, e.g., a paper towel, on the backing portion.

Since the cleaning article of the invention is designed to hold a cleaning member releasably, the cleaning member can be changed when it becomes dirty. This permits a better cleaning action to be obtained. Moreover, by making the gripping portion appropriately, the cleaning member will be firmly held, thereby allowing the cleaning action to be further enhanced. The fact that the gripping portion is discrete from the backing portion also enables the cleaning article to be relatively versatile. Thus, it becomes possible to use different types of cleaning members as well as cleaning members having different configurations and dimensions.

Another aspect of the invention resides in a method of assembling a cleaning article. The method comprises the steps of encircling at least part of a first element with a second element, and confining a portion of a cleaning member, e.g., a paper towel, between the first and second elements during or subsequent to the encircling step.

The first element is preferably discrete from the second element. The second element may be designed to resiliently urge the confined portion of the cleaning member towards the first element.

The cleaning member may have a pair of opposed marginal portions, and another portion intermediate the marginal portions. The confining step can here involve clamping the marginal portions of the cleaning member between the first and second elements. The method may then comprise the step of substantially flattening the portion of the cleaning member intermediate the marginal portions.

The method can further comprise the steps of removing the second element from the first element, reencircling the previously encircled part of the first element with the second element, and confining a portion of another cleaning member between the first and second elements during or subsequent to the reencircling step.

Additional features and advantages of the invention will be forthcoming from the following detailed description of preferred embodiments when read in conjunction with the accompanying drawings.

DESCRIPTION OF THE PREFERRED EMBODIMENTS

Figure 1:
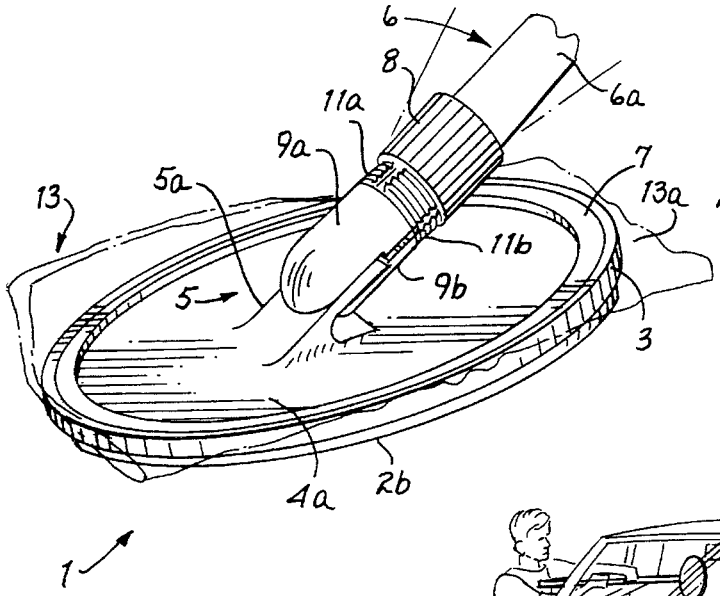
FIG. 1 is a perspective view of one embodiment of a cleaning article in accordance with the invention.

FIGS. 1–4 illustrate one embodiment of a cleaning article or device according to the invention. The cleaning article, which is identified generally by the numeral 1, includes a backing portion 2 and a gripping or holding portion 3. The gripping portion 3 is discrete or separate from the backing portion 2.

The backing portion 2 comprises a backing element **2*a* and another backing element 2*b* which is discrete or separate from the backing element 2*a*. The two backing elements 2*a* and 2*b*** are generally oval or elliptical and have approximately equal cross-sectional areas.

The backing element **2*a* is relatively rigid or firm and is preferably made of plastic. The firm backing element 2*a* includes a sheet-like central section 4 having opposed, flat major surfaces 4*a* and 4*b*. A protuberance 5 projects from the major surface 4*a* at the middle of the central section 4 and includes a flat tab or tongue 5*a* which is inclined to the major surface 4*a*. The tab 5*a* is provided with an opening 5*b* and serves as a connecting means for attachment of a handle 6 to the cleaning article 1**.

The firm backing element **2*a* further includes an annular rim or margin 7 which surrounds the central section 4. The rim 7 projects beyond the major surface 4*a* but not the major surface 4*b*. An annular bevel 7*a* circumscribing the central section 4 of the firm backing element 2*a* may be formed on the rim 7 in the region adjacent the major surface 4***b* of the central section 4.

The backing element 2*b* is sheet-like and deformable or pliant. The deformable backing element 2*b* is preferably resilient or elastic and can, for example, be made of a foamed material such as foamed rubber.

The gripping portion 3 of the cleaning article 1 is in the form of an elastic or resilient ring which is preferably composed of rubber. The circumference of the gripping ring 3 in its relaxed or unstressed condition is less than the circumference of the firm backing element 2*a*.

The handle 6 comprises a shaft 6*a* which is provided with a cap 6*b* at one end thereof. The cap 6*b* is designed to be held by a user of the cleaning article 1. The end of the shaft 6*a* remote from the cap 6*b* has a collar 6*c*, and an internally threaded locknut 8 is retained on the shaft 6*a* by means of the cap 6*b* and the collar 6*c*. The shaft 6*a* has an extension 6*d* to the side of the collar 6*c* remote from the cap 6*b*.

The handle 6 additionally comprises a pair of discrete connecting members 9*a* and 9*b* having flat faces which are designed to abut the two sides of the tab 5*a*. A projection 10 protrudes from the flat face of the connecting member 9*a* and is receivable in the opening 5*b* of the tab 5*a*. The connecting members 9*a* and 9*b* have respective ends 11*a* and 11*b* which are provided with threaded, part-cylindrical outer surfaces, and the threaded ends 11*a* and 11*b* of the connecting members 9*a* and 9*b* are formed with respective recesses 12*a* and 12*b*.

Figure 3:
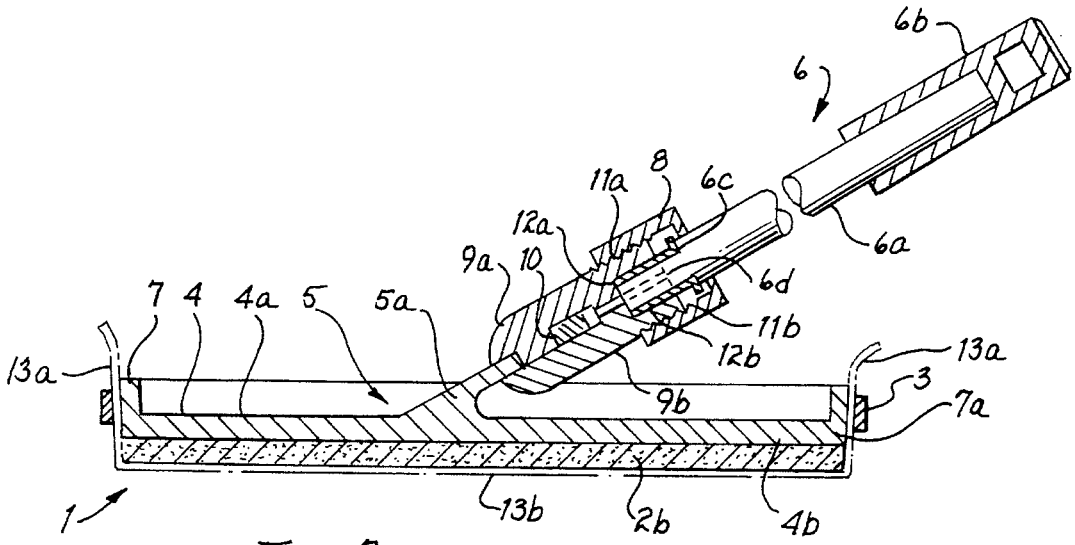
FIG. 3 is a sectional view of the cleaning article of FIG. 1.
Figure 4:
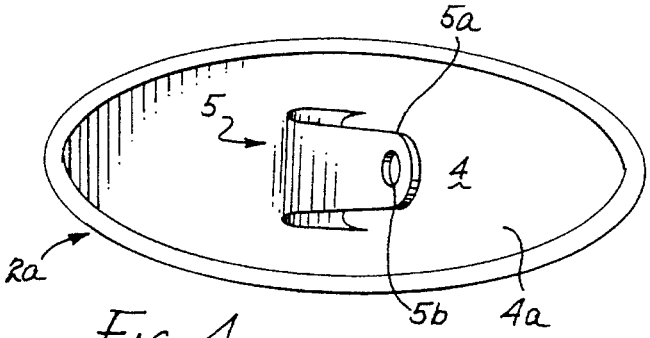
FIG. 4 is a plan view of a backing element constituting part of the cleaning article of FIG. 1.

The manner of connecting the handle 6 to the firm backing element 2*a* can be seen from FIG. 3. The projection 10 of the connecting member 9*a* is inserted in the opening 5*b* of the tab 5*a* so that the flat face of the connecting member 9*a* abuts one side of the tab 5*a*. The flat face of the connecting member 9*b* is placed against the other side of the tab 5*a*, and the connecting members 9*a* and 9*b* are positioned in such a way that the threaded end 11*a* of the connecting member 9*a* is opposite the threaded end 11*b* of the connecting member 9*b*. In this position, the threaded ends 11*a* and 11*b* of the connecting members 9*a* and 9*b* cooperate to form an externally threaded, substantially cylindrical element having an internal passage which is defined by the recesses 12*a* and 12*b* and opens in a direction away from the tab 5*a*. The externally threaded cylindrical element is designed to mesh with the internally threaded locknut 8, and the internal passage of the cylindrical element is designed to receive the extension 6*d* of the shaft 6*a*. The handle 6 is secured to the tab 5*a* of the firm backing element a by inserting the extension 6*d* into the internal,passage of the connecting members 9*a* and 9*b* and screwing the locknut 8 onto the treaded ends of the connecting members 9*a* and 9*b*.

The cleaning article 1 is assembled as follows:

The deformable backing element 2*b* is oriented in the same manner as the firm backing element 2*a* and one of the major surfaces of the deformable backing element 2*b* is placed against the major surface 4*b* of the firm backing element 2*a*. A flexible cleaning member 13 is positioned adjacent that major surface of the deformable backing element 2*b* which faces away from the firm backing element 2*a*. The cleaning member 13 is here assumed to be a paper towel but could also be a cloth or some other article capable of providing a cleaning action. The paper towel 13 is shown as being folded in half.

The length dimension of the paper towel 13 runs in the direction of the major axes of the oval backing elements 2*a* and 2*b*. The length of the paper towel 13 exceeds the lengths of the backing elements 2*a* and 2*b*, and the paper towel 13 has a pair of opposed marginal portions or end portions 13*a* which project beyond the backing elements 2*a* and 2*b*. The marginal portions 13*a* of the paper towel 13 are spanned by a cleaning portion 13*b*. Although the edges or lateral marginal regions of the cleaning portion 13*b* may project laterally of the backing elements 2*a* and 2*b*, the major part of the cleaning portion 13*b* is juxtaposed with the deformable backing element 2*b*.

Once the paper towel 13 has been properly positioned adjacent the deformable backing element 2*b*, the resilient ring 3 is placed on the side of the paper towel 13 remote from the deformable backing element 2*b*. The ring 3 and the firm backing element 2*a* are drawn towards one another thereby causing the projecting marginal portions 13*a* of the paper towel 13, as well as any projecting edge of the cleaning portion 13*b*, to be folded around the deformable backing element 2*b*. Movement of the ring 3 and the firm backing element 2*a* relative to each other continues until the ring 3 has passed by the deformable backing element 2*b* and circumscribes the rim 7 of the firm backing element 2*a*. In this position, the marginal portions 13*a* and any projecting edge of the cleaning portion 13*b* are confined between the ring 3 and the firm backing element 2*a*.

Since the circumference of the ring 3 in its relaxed condition is smaller than the circumference of the firm backing element 2*a*, the ring 3 must be stretched in order to draw the ring 3 around the rim 7 of the firm backing element 2*a*. Hence, the ring 3 resiliently clamps the marginal portions 13*a* and any projecting edge of the cleaning portion 13*b* between itself and the firm backing element 2*a*.

The part of the cleaning portion 13*b* which is juxtaposed with the deformable backing element 2*b* preferably lies flat against the deformable backing element 2*b*. Flattening of the cleaning portion 13*b* can take place as the ring 3 and the firm backing element 2*a* are drawn to one another. If the cleaning portion 13*b* does not lie flat against the deformable backing element 2*b* after the ring 3 has been positioned around the firm backing element 2*a*, the cleaning portion 13*b* may be flattened by carefully pulling on the marginal portions 13*a* of the paper towel 13 and on any projecting edge of the cleaning portion 13*b*.

The paper towel 13 is releasably clamped between the ring 3 and the firm backing element 2*a*. The paper towel 13 can be released by stretching the ring 3 and sliding out the paper towel 13 or by removing the ring 3 from the firm backing element 2*a*. Clamping of the paper towel 13 between the ring 3 and the firm backing element 2*a*, as well as release of the paper towel 13, can be carried out while the handle 6 is attached to or disattached from the tab 5*a* of the firm backing element 2*a*.

Figure 5:
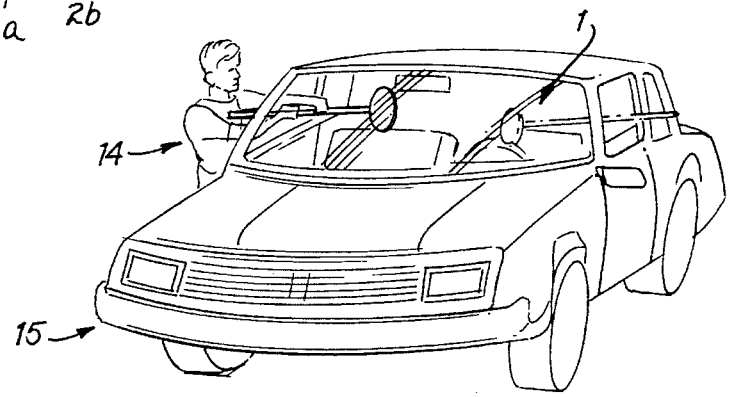
FIG. 5 shows the cleaning article of FIG. 1 being used to clean the interior of an automobile.
Figure 2:
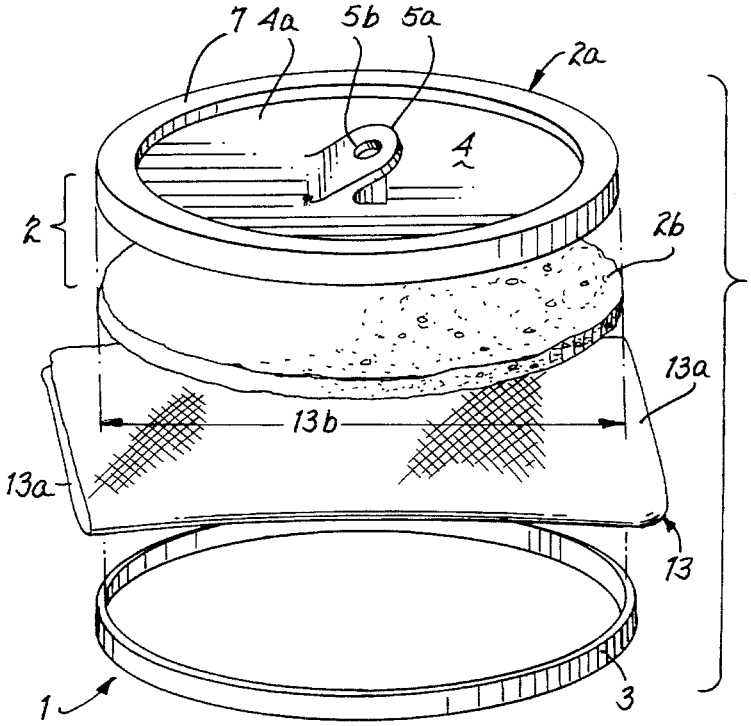
FIG. 2 is a perspective view illustrating the assembly of the cleaning article of FIG. 1.

In FIG. 5, a person 14 is using the cleaning article 1 to clean the interior of an automobile 15. The person 14 grasps the cap 6*a* of the handle 6 and manipulates the cleaning article 1 so as to run the cleaning portion 13*b* of the paper towel 13 over the surfaces to be cleaned. For instance, the cleaning article can be used to dust the dashboard of the automobile 15, to remove dirt films from the interior surfaces of the windows of the automobile 15, and to remove debris from the upholstery of the automobile 15.

The handle 6 of the cleaning article 1 allows the person 14 to clean the interior of the automobile 15 while standing outside of the automobile 15. FIG. 5 shows the person 14 standing on the passenger side of the automobile 15 and cleaning the interior of the automobile 15 via a window on the passenger side. However, as illustrated, it is also possible to clean the interior of the automobile 15 through a window on the driver's side of the automobile 15. The cleaning article 1 can find applications other than cleaning automobiles.

The cleaning article 1 makes it possible to achieve an efficient cleaning action. Thus, the paper towel 13 can be readily replaced when it becomes dirty. To this end, the ring 3 is removed from the firm backing element 2*a* thereby releasing the paper towel 13. A fresh paper towel can then be mounted on the cleaning article 1 in the manner described above. The cleaning action is enhanced because the ring 3 causes the paper towel 13 to be firmly gripped.

The cleaning article 1 is also quite versatile due to the fact that the ring 3 is discrete from the backing elements 2*a*, 2*b*. By virtue of this feature, the cleaning article 1 is not limited to any particular type of cleaning member, or to a cleaning member having a specific configuration or specific dimensions.

The deformable backing element 2*b* prevents the cleaning article 1 from scratching or otherwise damaging a Surface being cleaned.

Figure 8:
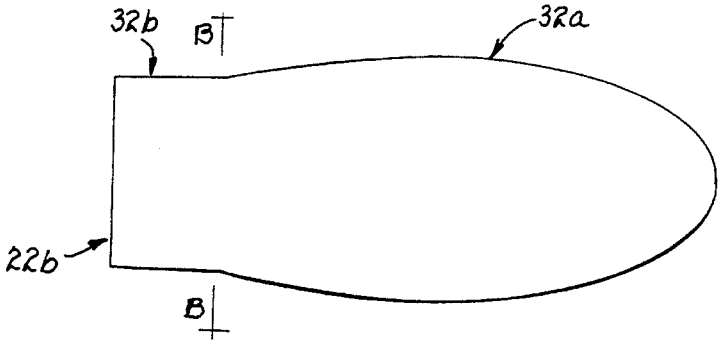
FIG. 8 is a plan view of another backing element constituting part of the cleaning article of FIG. 6.
Figure 6:
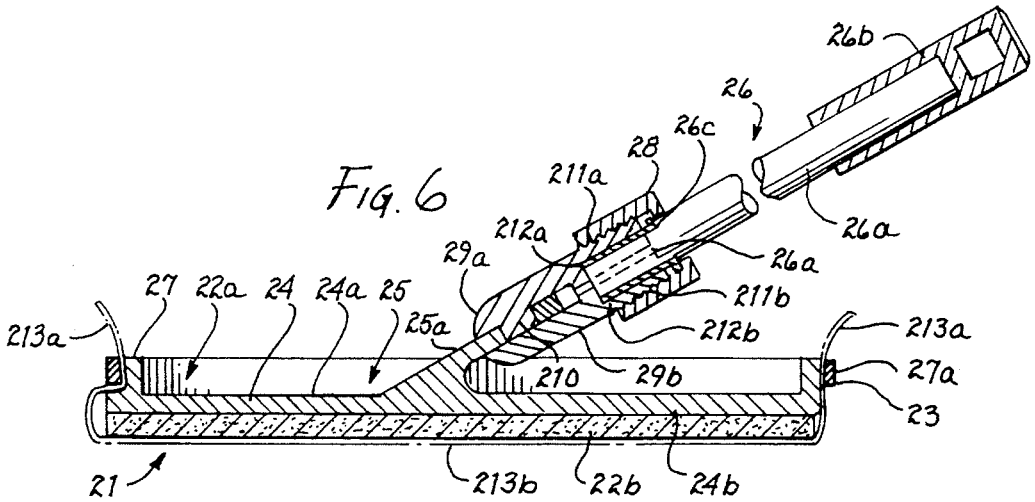
FIG. 6 is a sectional view of another embodiment of a cleaning article according to the invention.
Figure 7:
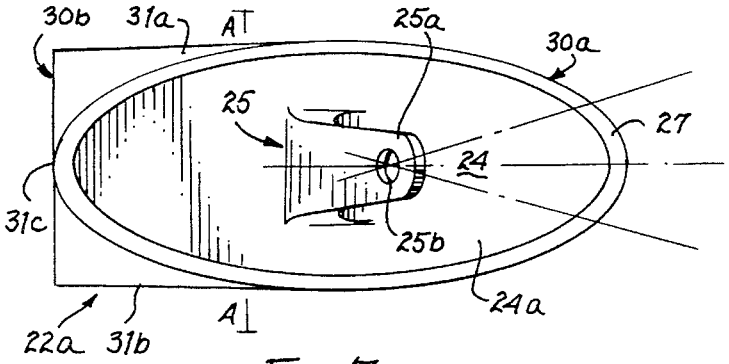
FIG. 7 is a plan view of a backing element constituting part of the cleaning article of FIG. 6.

FIGS. 6, 7 and 8 illustrate another embodiment of the cleaning article of the invention. In FIGS. 6–8, the same numerals as in FIGS. 1–4, but with the prefix "2" are used to identify corresponding elements.

The cleaning article 21 of FIGS. 6–8 differs from the cleaning article 1 of FIGS. 1–4 primarily in the design of the backing elements.

Referring to FIG. 7, the firm backing element 22*a* of the cleaning article 21 has an oval or elliptical part 30*a* and an approximately C-shaped part or lip 30*b*. The oval part 30*a* can be identical to the firm backing element 2*a* of FIGS. 1–4. The C-shaped part 30*b*, which is flat, projects from one end of the oval part 30*a* in the direction of the major axis of the oval part 30*a*. The C-shaped part 30*b* has two flat and straight edge faces or sides 31*a* and 31*b* which extend from the oval part 30*a* on opposite sides of the major axis of the oval part 30*a*. The edge faces 31*a* and 31*b*, which are parallel to one another and to such major axis, intersect the oval part 30*a* in a plane A—A normal to the major surfaces 24*a* and 24*b* (see FIG. 6) of the oval part 30*a*. The C-shaped part 30*b* has a third straight and flat edge face or side 31*c* which bridges the parallel edge faces 31*a* and 31*b* and is perpendicular to the major axis of the oval part 30*a*.

With reference to FIG. 8, the deformable backing element 22*b* of the cleaning article 21 includes two sections or segments 32*a* and 32*b* which are located on opposite sides of and meet at a plane B—B normal to the major surfaces of the deformable backing element 22*b*. The section 32*a*, which lies to the right of the plane B—B, is part-oval or part-elliptical in plan and matches or approximately matches the section of the firm backing element 22*a* to the right of the plane A—A (see FIG. 7). The section 32*b* lying to the left of the plane B—B is polygonal, e.g., square or rectangular, in plan and corresponds at least approximately to the section of the firm backing element 22*b* to the left of the plane A—A (see FIG. 7). Thus, when placed against the major surface 24*b* (see FIG. 6) of the firm backing element 22*a*, the deformable backing element 22*b* can be made to coincide, or almost coincide, with the firm backing element 22*a* (see FIG. 6).

The backing elements 22*a* and 22*b* have an outline resembling that of a mitten.

The cleaning article 21 is assembled in the same manner as the cleaning article 1. However, assembly of the cleaning article 21 is simplified if the ring 23 is drawn over the C-shaped part or lip 30*b* of the firm backing element 22*a* before being drawn around the section of the firm backing element 22*a* to the right of the plane A—A.

The C-shaped part or lip 30*b* of the firm backing element 22*a* is useful for getting into corners of an object being cleaned.

Figure 9:
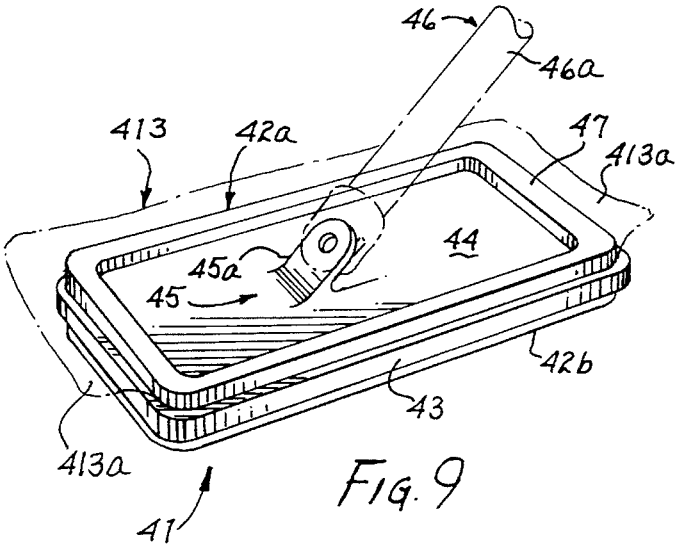
FIG. 9 is a perspective view of an additional embodiment of a cleaning article in accordance with the invention.
Figure 10:
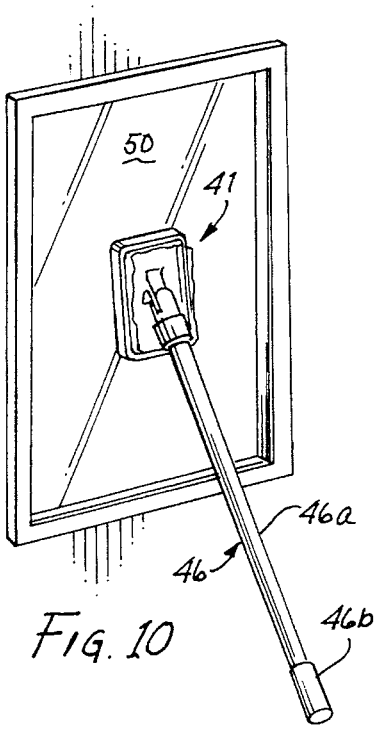
FIG. 10 shows the cleaning article of FIG. 9 being used to clean a windowpane.

FIGS. 9 and 10 show an additional embodiment of the cleaning article according to the invention. In FIGS. 9 and 10, the same numerals as in FIGS. 1–4, but with the prefix "4" are used to denote corresponding elements.

The cleaning article 41 of FIGS. 9 and 10 differs from the cleaning article 1 of FIGS. 1–4 mainly in that the backing elements 42*a* and 42*b*, and possibly the ring 43, of the cleaning article 41 are rectangular rather than oval.

FIG. 10 illustrates the cleaning article 41 being used to clean a rectangular windowpane 50. The rectangular shape of the cleaning article 41 makes it easier to access the corners of the windowpane 50. The same effect can be achieved by making the backing elements 42*a* and 42*b* and the ring 43 square.

Various modifications can be made within the meaning and range of equivalence of the appended claims.

What is claimed is:

1. A glass cleaning device for cleaning automobile windows, said device comprising:

a flexible glass cleaning sheet;

a first backing element, said first backing element being of substantially rigid, one-piece construction and including a planar central section having opposing first and second substantially flat surfaces, said backing element further including a peripheral annular rim connected with and surrounding said first surface and an elongated, planar connecting tongue extending from said first surface at an acute angle thereto, said tongue defining opposed substantially flat sides and having an opening therein extending perpendicularly therethrough, said opening extending at an acute angle to said first surface;

a second backing element, said second backing element is substantially flat and comprised of deformable material;

gripping means discrete from said backing elements releasably holding said glass cleaning sheet flatly and tautly about and to the entire periphery of the annular rim, wherein said second backing element is captured between the cleaning sheet and the first backing element;

a handle, said handle comprising an elongated shaft having at one end thereof first and second elongated connecting members, said connecting members together defining, at first ends thereof, a threaded outer surface and, at second ends thereof, opposed substantially flat faces, said flat face of said first connecting member having a projection extending perpendicularly therefrom, wherein the opposed flat faces engage, respectively, the opposed flat sides of said tongue, with the projection extending through the opening, a locknut engages said threaded outer surface to both secure said connecting members together, thereby locking said members with said tongue, and to secure said connecting members to said shaft thereby securing the handle to the first backing element.

2. The device of claim 1 wherein said first and second backing elements are substantially mitten-shaped and each of said elements comprises a part-oval segment and a polygonal segment.

3. The device of claim 1 wherein said first backing and said backing elements is comprised of plastic.

4. The device of claim 1 wherein said second backing element is resilient.

5. The device of claim 4 wherein said second backing element is comprised of foam rubber.

6. The device of claim 1 wherein said backing elements are substantially oval.

7. The device of claim 1 wherein said backing elements are have a substantially oval part and another part which projects from said oval part.

8. The device of claim 7 wherein each said oval part has a major axis and said other parts project from respectine said oval part in a direction along said axis.

9. The device of claim 7 wherein each said other part has a pair of first sides which extend from respective oval parts and a second side running between said first sides.

10. The device of claim 9 wherein each said oval part has a major axis and said respective first sides thereof are substantially parallel to said major axis thereof, said second sides thereof being substantially perpendicular to said respective major axes.

11. The device of claim 7 wherein each said other part is substantially flat.

12. The device of claim 1 wherein said backing elements are substantially rectangular.

13. The device of claim 1 wherein said gripping portion means embraces at least part of said backing portion to clamp said cleaning member between said gripping portion means and said backing portion.

14. The device of claim 13 wherein said gripping portion means is substantially round.

15. The device of claim 13 wherein said gripping portion means is resilient.

16. The device of claim 15 wherein said gripping portion means comprises rubber.

* * * * *